United States Patent [19]

Bissett

[11] 4,061,102

[45] Dec. 6, 1977

[54] ROLL STABILIZER FOR BOATS

[76] Inventor: Thomas B. Bissett, 5530 Topa Topa Drive, Ventura, Calif. 93003

[21] Appl. No.: 736,519

[22] Filed: Oct. 28, 1976

[51] Int. Cl.[2] ..... B63B 39/00; B63B 43/02

[52] U.S. Cl. ..... 114/122; 416/68; 115/31; 114/126

[58] Field of Search ..... 115/31; 114/311, 16 R, 114/242, 244, 245, 253, 121, 122, 126, 39; 416/64–70 R, 70 A, 73; 9/310 R, 310 C, 310 D, 400

[56] References Cited

U.S. PATENT DOCUMENTS

| | | | |
|---|---|---|---|
| 728,330 | 5/1903 | Temperley | 114/311 |
| 2,333,171 | 11/1943 | Gorr | 416/68 |
| 3,029,767 | 4/1962 | Donnan | 114/311 |
| 3,589,324 | 6/1971 | Hoffman | 114/122 |
| 3,830,189 | 8/1974 | Yamanaka | 115/31 |

*Primary Examiner*—Trygve M. Blix
*Assistant Examiner*—D. W. Keen
*Attorney, Agent, or Firm*—Charles H. Schwartz

[57] ABSTRACT

A stabilizer device for minimizing the roll of a boat including two plates connected by a hinge and a plurality of bridles attached to the plates so that when the stabilizer is pulled up through the water by the bridles the plates open about the hinge to resist upward motion and when the stabilizer is released the plates close together about the hinge to permit the stabilizer to fall rapidly.

3 Claims, 6 Drawing Figures

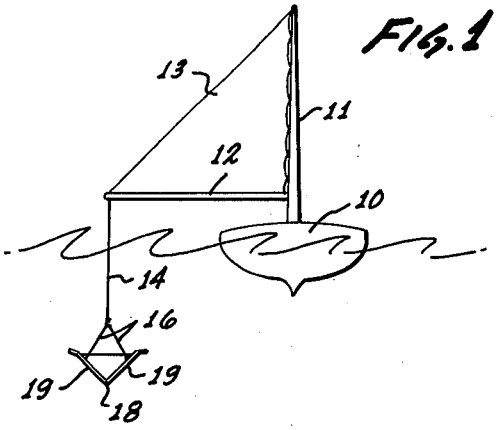
FIG. 1
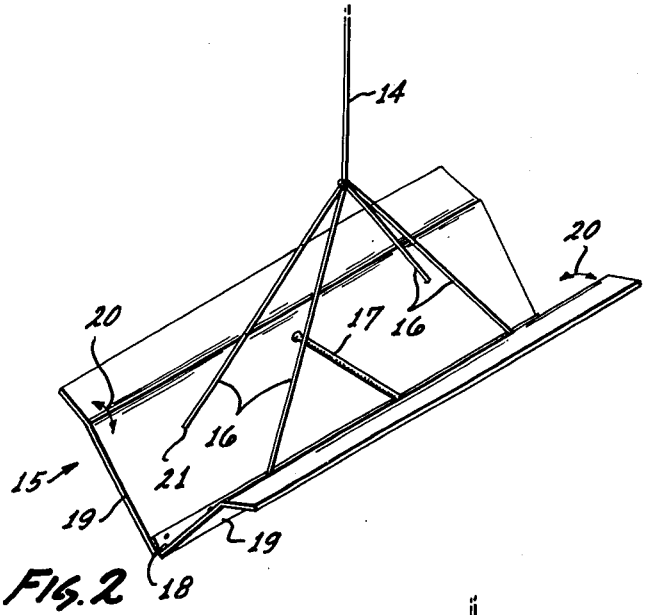
FIG. 2
FIG. 3
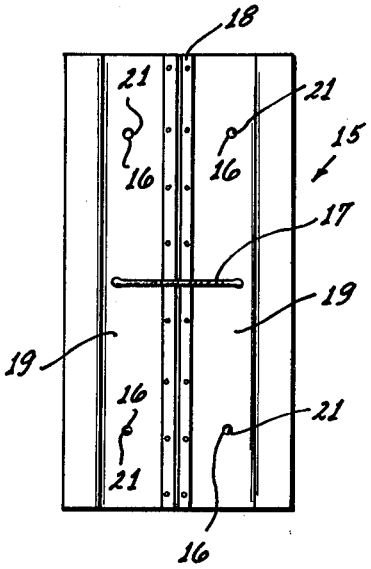
FIG. 4
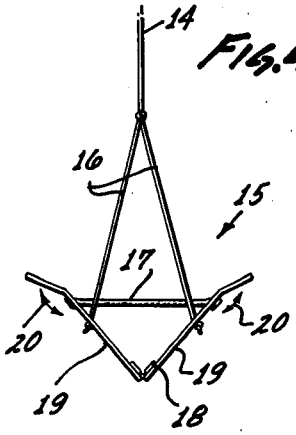
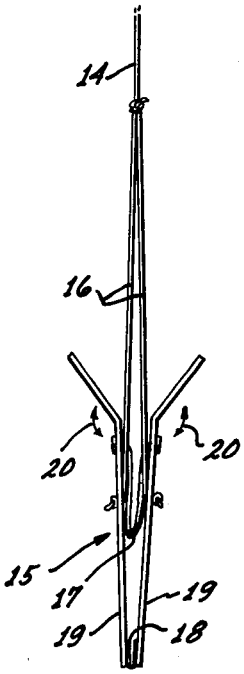
FIG. 5
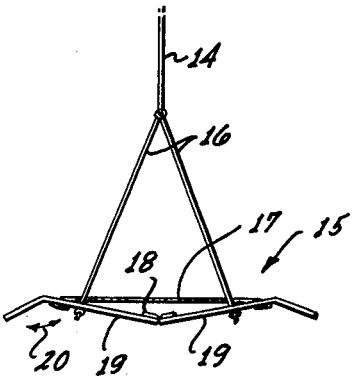
FIG. 6

ROLL STABILIZER FOR BOATS

The present invention relates to an improved roll stabilizer for use with boats. Many times boats are moored or anchored in water that is not calm. Depending on the frequency of the waves present and the roll characteristics of the boat, violent rocking may occur as the frequency of the waves match or nearly match the natural frequency of the boat. This rocking motion can be very unpleasant and may make it difficult to sleep or work about the boat. The purpose of the invention is to reduce this rolling motion while the boat is otherwise stationary in the water, such as when the boat is either moored, at anchor or while drifting.

Prior art devices designed for roll stabilizing generally require a relatively heavy device and which devices include some structure to reduce the water resistance in one direction. For example, some prior art devices include frame members with flaps while other prior devices have a tapered configuration to reduce water resistance.

The present invention has a much lower water resistance in one direction than the other direction than the prior art devices. In addition, the present invention does not depend primarily on weight but rather provides for a substantial reduction in surface area in one direction to reduce the water resistance.

Generally the present invention includes a pair of hinged plates which open in one direction to provide a large drag and which close in the other direction to reduce the water resistance to allow the roll stabilizer to fall rapidly in the water.

Among the other advantages of the present invention are lightness of weight, compact size for storage, resistance to clogging by kelp and seawood and, in addition, non-magnetic and non-rusting materials may be used in the construction. The present invention is also silent in its operation. The present invention can also serve as a warp or sea anchor in an emergency.

A clearer understanding of the invention will be had with reference to the following description and drawings wherein FIG. 1 is a schematic drawing showing a roll stabilizer of the present invention in a position with respect to a sailboat;

FIG. 2 is a perspective view of the stabilizer of the present invention;

FIG. 3 is a top view of the present invention while partially extended;

FIG. 4 is an end view of the present invention also while partially extended;

FIG. 5 is an end view of the present invention while fully contracted; and

FIG. 6 is an end view of the present invention while fully extended.

Referring to the drawings, a boat 10 is usually provided with a mast 11 to which an extender pole 12 and a topping lift line 13 can be added. On boats without a mast, the extender pole 12 can be attached to the side of the boat and the topping lift 13 run to a point on the superstructure of the boat. At the end of the pole 12 a line 14 is attached. At the end of the line 14 the roll stabilizer 15 of the present invention is attached such that it is a few feet below the surface of the water.

As the boat 10 rolls away from the stabilizer 15, or clockwise in the drawing, the stabilizer 15 is lifted up through the water. As the stabilizer is moved upward, the dynamic water pressure on its surface forces the stabilizer to open as shown in FIG. 6. In the open position the stabilizer 15 presents a large drag surface and vigorously resists the upward motion and thus the roll of the boat. As the boat 10 rolls toward the pole 12, or counterclockwise in the drawing, the stabilizer 15 is permitted to fall through the water. Due to the dynamic water pressure on its surfaces and its unique design, the stabilizer 15 folds up, as shown in FIG. 5, to present a very low drag profile to the water. The stabilizer 15 quickly drops in the water and thus is in position to resist the next upward surge. If the boat is not rolling, the stabilizer 15 assumes a partially open position as shown in FIG. 4.

The stabilizer 15 is fitted with a bridle 16 which is attached to the folding plates 19 at attachment points 21. The proper location of these attachment points 21 causes the stabilizer 15 to open quickly and yet not open too far to thus turn itself inside out.

The attachment points 21 are positioned to be slightly more than half way from a hinge 18 to the extreme edge, the exact location depending upon the exact shape and size of the plates 19 used. The location of the attachment points 21 in the other direction, i.e., parallel to the hinge, is not critical but should be near the outer edge.

In order to make the location of the attachment points 21 of the bridle 16 less critical, the two plates 19 can be fitted with a stop which limits the angle to which the stabilizer will open. The stop can take many forms. One example is to use a spring 17 that has a limit to its extension.

The major purpose of the spring 17 is to speed up the downward motion of the stabilizer 15 as the boat rolls toward the pole 12 or counterclockwise. For example, assume the boat has rolled to the right or clockwise. The stabilizer 15 has thus opened fully as shown in FIG. 6 and the spring 17 is in a stretched position. As the boat rolls to the left, or counterclockwise, the stabilizer is permitted to fall and the spring 17 contracts to pull the plates 19 together, thus causing the stabilizer 15 to fall faster due to a reduced water resistance. Although the invention will work without the spring 17, the performance is improved by increasing the speed at which the stabilizer can fall in the water.

The plates 19 may also include bends 20 in the plate for two reasons. First, the bends 20 stiffen the plates 19 thereby permitting thinner material to be used. Second, the bends 20 increase the speed of response of the stabilizer 15 by causing the stabilizer to open and close more quickly. However, the stabilizer will function without the bends 20.

The stabilizer 15 must be of sufficient weight to cause it to be heavier than the water it displaces, but the stabilizer 15 does not have to be significantly heavier. This relatively light weight requirement is permitted because of the unique hydrodynamic design and permits a wide choice of materials to be employed in the fabrication of the stabilizer. A combination of materials which offers special advantages wherein light material, small size, non-magnetic, non-rusting, and rugged devices are important are as follows:

Plates (19) — Aluminum
Hinge (18) — Plastic such as polyethylene or polypropylene
Spring (17) — Rubber and plastic
Bridle (16) — Dacron rope.

The stabilizer of the present invention has an additional advantage due to its light weight and dynamic drag characteristic in that it can be employed in an emergency as a warp or sea anchor. The stabilizer may be deployed off the bow or stern for the purpose of slowing the boat's drift through the water in high winds and holding the boat's end (bow or stern depending on where the stabilizer is tethered) into the wind and waves.

Although this application has been disclosed and illustrated with reference to particular applications, the principles involved are susceptible of numerous other applications which will be apparent to persons skilled in the art. The invention is, therefore, to be limited only as indicated by the scope of the appended claims.

I claim:

1. A stabilizer device for minimizing the roll of a boat including two plates connected by a hinge, a plurality of bridles attached to the plates and with the bridle supporting the stabilizer in the water so that when the stabilizer is pulled up through the water by the bridles the plates open about the hinge to resist upward motion and when the stabilizer is released the plates close together about the hinge to permit the stabilizer to fall rapidly, and a spring attached between the plates normally pulling the plates toward the closed position to increase the speed of closing of the plates to increase the speed of fall.

2. The stabilizer of claim 1 additionally including a stop to prevent the stabilizer from opening more than a fixed amount.

3. The stabilizer of claim 1 additionally including at least one bend in at least one of the plates to increase the speed of opening and closing of the stabilizer.

* * * * *